US006421015B1

(12) United States Patent
Chen

(10) Patent No.: US 6,421,015 B1
(45) Date of Patent: Jul. 16, 2002

(54) PLANAR HELIX ANTENNA WITH TWO FREQUENCIES

(75) Inventor: I-Fong Chen, Tao-Yuan (TW)

(73) Assignee: Auden Techno Corp (TW)

( * ) Notice: Subject to any disclaimer, the term of this patent is extended or adjusted under 35 U.S.C. 154(b) by 0 days.

(21) Appl. No.: 09/750,796

(22) Filed: Jan. 2, 2001

(51) Int. Cl.[7] ..... H01Q 1/38
(52) U.S. Cl. ..... 343/700 MS; 343/895
(58) Field of Search ..... 343/700 MS, 702, 343/895, 873

(56) References Cited

U.S. PATENT DOCUMENTS 5,517,206 A * 5/1996 Boone et al. ..... 343/806
6,064,351 A * 5/2000 Mandai et al. ..... 343/873

* cited by examiner

*Primary Examiner*—Don Wong
*Assistant Examiner*—Hoang Nguyen
(74) *Attorney, Agent, or Firm*—Troxell Law Office PLLC

(57) ABSTRACT

A planar helix antenna with two frequencies, comprising a circuit board with suitable area and thickness and an upper and a bottom surface on which several microstrip antenna sections are disposed in a an inclined and mutually spaced way, wherein, through holes are provided on the circuit board for conjunction ends of the antenna sections on the upper and bottom surfaces for electric connection to form a planar helix microstrip antenna; the top most end of the antenna sections has top loading, while the bottom end thereof is an out feeding point. The antenna sections get a high frequency harmonic oscillation point by coupling; while connection of these microstrip antenna sections on the front and the back sides can form by its electrical gross length a low frequency harmonic oscillation point. Such variation of space and top loading of the microstrip antenna sections can endue the dual frequency planar and miniaturized helix microstrip antenna with superior performance.

6 Claims, 2 Drawing Sheets

PLANAR HELIX ANTENNA WITH TWO FREQUENCIES

BACKGROUND OF THE INVENTION

1. Field of the Invention

The present invention is related to a planar helix antenna with two frequencies, and especially to an antenna with the performance of dual frequency only by a planar helical structure.

2. Description of the Prior Art

It is the primary antenna type having a helical coil made from winding of a metal wire, diameter and material of the coil as well as the total length of such a helix antenna can influence the set functions thereof. However, such a helix antenna still is widely adopted and has a quite stable signal emitting and receiving structure. In meeting the requirement of modern communication equipment, such a helix antenna can get various resonance frequencies through different structural designs. For example, Japanese patent No. 1997-320748 has a helical coil provided in an external sleeve, and an adjusting member is extended in the external sleeve, length of the adjusting member determines its resonance frequency. British patent No. 2,206,243 has a linear conductor extended into a helical coil to form a dual frequency antenna. These helical coils are disadvantageous in being geometrically solid and having larger volumes though, they do not certainly suit modern communication equipment that is miniature and is supposed to use a built-in antenna (such as a mobile phone or a portable computer).

Thereby, there are various miniaturized and planar microstrip antennas being developed gradually. However, earlier microstrip antennas, such as are disclosed in U.S. Pat. No. 3,921,177 and 3,810,183, generally are made from round or rectangular thin metallic rods, dielectric substance is filled in the space between such an antenna and the grounding member. Such a microstrip antenna generally can only allow narrower width of frequency. U.S. patent application Ser. No. 07/695686 provides a polygonal helical microstrip antenna which is improved against the earlier microstrip antennas, the width of frequency thereof can approach that of a normal helix antenna with a constant impedance. But this microstrip antenna is disadvantageous in having quite a large diameter when in low frequency, and does not suit modern portable communication equipment.

Pointing to this, U.S. patent application Ser. No. 07/798700 (Taiwan patent no.81108896) provides a smaller microstrip antenna of broadband. However, the helical antenna element thereof is provided on a grounding plate, and dielectric substance and bearing material are filled in the space between it and the plate; the antenna can hardly further be reduced, and its signal emitting and receiving function is inferior to that of a helix antenna.

SUMMARY OF THE INVENTION

The object of the present invention is to provide a planar helix antenna with two frequencies; the performance of a dual frequency antenna can be achieved by a planar helical structure.

To get the object, the present invention is provided on both the upper and the bottom sides of an electric circuit board with corresponding microstrip antenna sections, these microstrip antenna sections on the front and the back sides can cooperatively form a helix antenna, through holes are provided on the circuit board for the conjunction ends of the microstrip antenna sections for electric connection. The top most end of the microstrip antenna sections has top loading, by setting spaces between the microstrip antenna sections, the planar helix antenna can get a high frequency harmonic oscillation point by coupling; while connection of these microstrip antenna sections on the front and the back sides can form a low frequency harmonic oscillation point by its electrical gross length.

The present invention will be apparent in its novelty as well as features after reading the detailed description of the preferred embodiment thereof in reference to the accompanying drawings.

DETAILED DESCRIPTION OF THE PREFERRED EMBODIMENT

Figure 1:
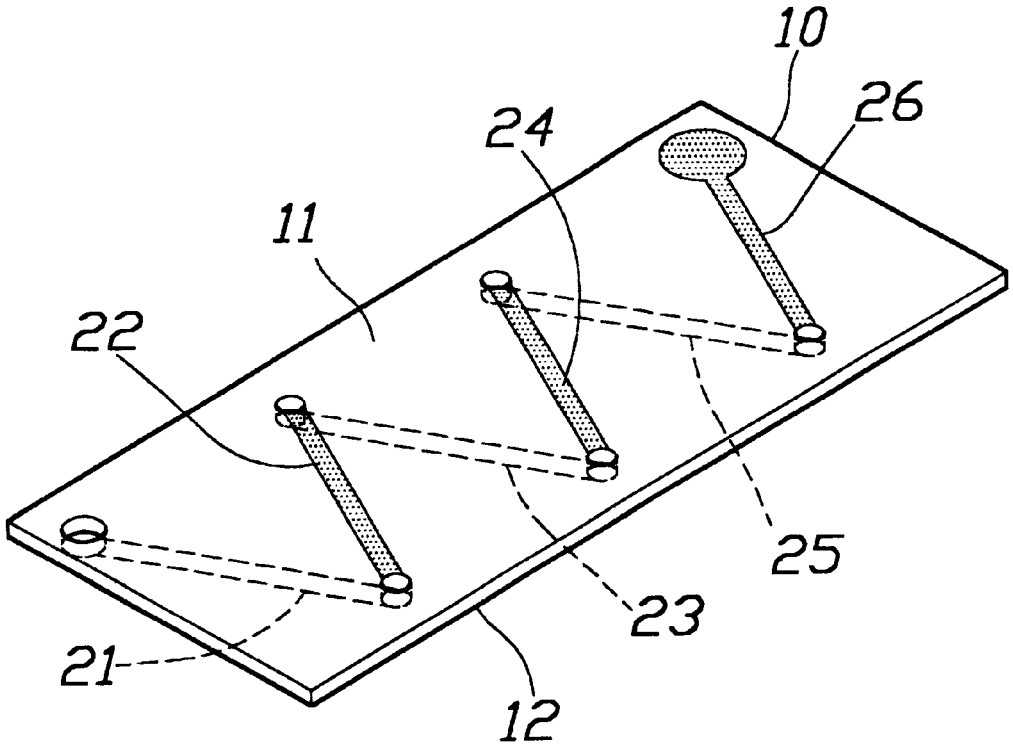
FIG. 1 is a perspective view showing a preferred embodiment of the present invention.
Figure 3:
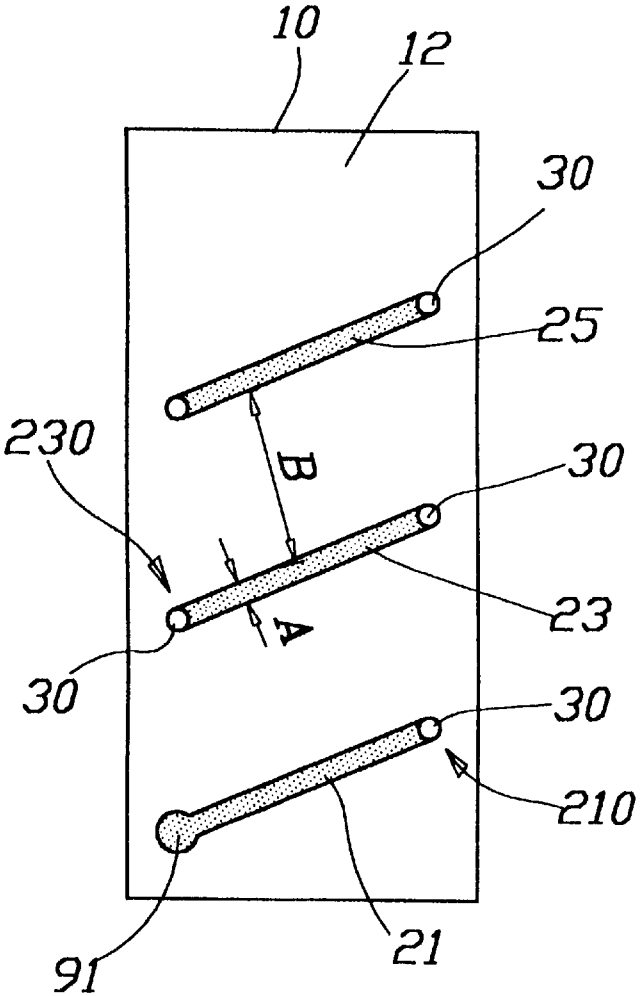
FIG. 3 is a rear view of FIG. 1.
Figure 2:
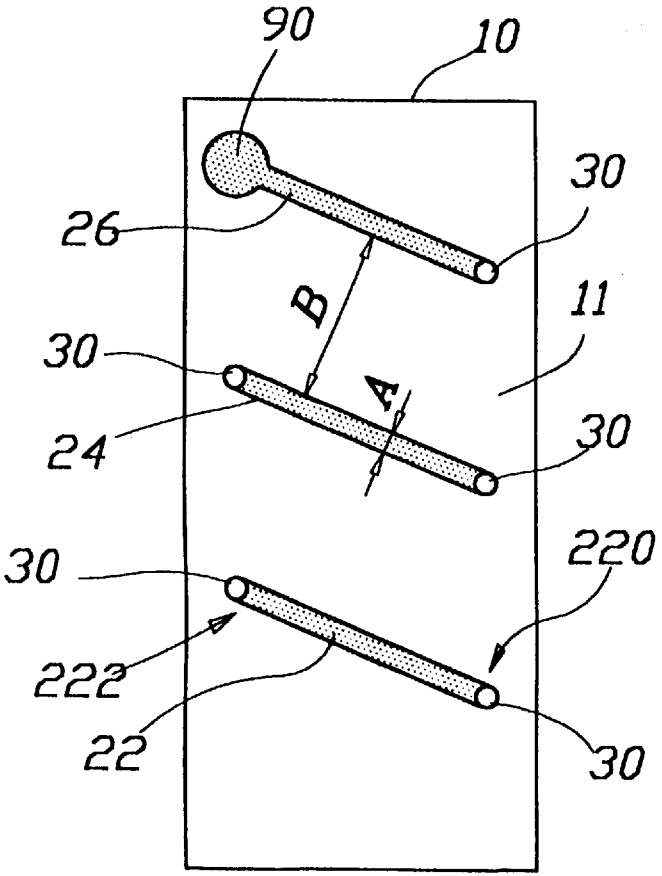
FIG. 2 is a front view of FIG. 1.

Referring to FIGS. 1–3, in this preferred embodiment of the present invention, there is an electric circuit board 10 with suitable area and thickness as well as having an upper surface 11 (i.e. the front side) and a bottom surface 12 (i.e. the rear side) on which a planar helix antenna with two frequencies can be formed.

In the embodiment shown, the upper surface 11 of the electric circuit board 10 has three mutually spaced microstrip antenna sections 22, 24 and 26 inclined rightwards, while the bottom surface 12 has three corresponding microstrip antenna sections 21, 23 and 25 inclined leftwards, all these microstrip antenna sections cooperatively compose the planar helix antenna. Connection of the microstrip antenna sections 22, 24 and 26 on the front side as well as the microstrip antenna sections 21, 23 and 25 on the rear side is made by providing a plurality of through holes 30 for connecting of the conjunction ends of the microstrip antenna sections. For example, the right lower antenna end 220 of the first microstrip antenna section 22 on the front side and the right upper antenna end 210 of the first microstrip antenna section 21 on the rear side form electric connection through a through hole 30; while the left upper antenna end 222 of the first microstrip antenna section 22 on the front side and the right lower antenna end 230 of the second microstrip antenna section 23 on the rear side form electric connection through another through hole 30. In this way, the microstrip antenna sections connect serially to form the planar helix microstrip antenna.

Figure 4:
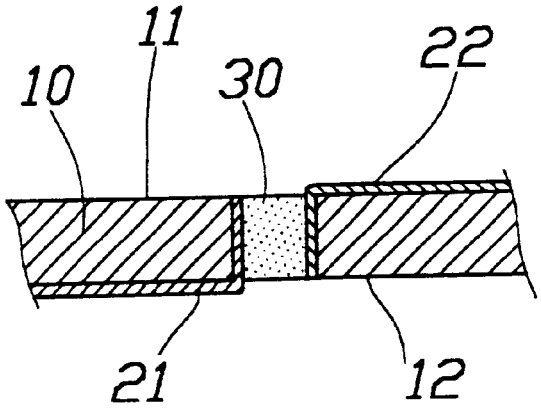
FIG. 4 is an enlarged sectional view showing a through hole in FIG. 1.

As shown in FIG. 4, according to the process of production now available, the abovementioned through hole 30 can be coated with metal by coating or electric plating after the holes are made on the electric circuit board 10. The microstrip antenna sections 22, 24 and 26 as well as the microstrip antenna sections 21, 23 and 25 on upper surface 11 and the bottom surface 12 of the electric circuit board 10 respectively then complete electric connection.

Width A of the planar helix microstrip antenna (directing to both the sections on the front side 11 as well as on the rear side 12) mainly is same as the width of a 50 ohm printed microstrip antenna, the microstrip antenna sections (on the front side 11 as well as on the rear side 12) have their space B of the sections which is most preferably 4 times of the width of the microstrip antenna sections 21, 23, 25 and 22, 24 and 26.

The present invention makes the helix antenna planar, the electric length of the antenna will be varied in pursuance of different dielectric constants. When the present invention is designed for ½ λ, the gross electric length will be shorter than that of a conventional helix antenna, this is mainly because that:

$$\lambda_e(\text{effective wavelength}) = \frac{\lambda(\text{wavelength})}{\sqrt{\epsilon_r}\ (\text{dielectriccons tan } t)}$$

By the fact that the medium between the wire sections of a conventional helix antenna is air, while in the present invention, it is the electric circuit board 10; dielectric coefficient of air is smaller than that of the electric circuit board, so that the gross electric length of the present invention is shorter than that of a conventional helix antenna.

According to the above statement that the top most end of the microstrip antenna sections has top loading 90, while the bottom end 91 thereof is an out feeding point. The top loading 90 is provided, according to the embodiment shown in the drawings, on the upper left end of the microstrip antenna section 26 on the front side, while the bottom out feeding point 91 is provided on the lower left end of the microstrip antenna section 21 on the rear side. Such top loading 90 can create an electric capacitor effect to reduce electric inductance of the antenna itself, so that width of frequency of the antenna can be increased, while electric length of the antenna is reduced. The width of the top loading 90 can be twice the width A of the microstrip antenna sections, while the length thereof can be 1/20 λ.

The microstrip antenna sections 22, 24, 26 or 21, 23, 25 (on the front side 11 or on the rear side 12) can get a high frequency harmonic oscillation point by coupling; the microstrip antenna sections of the front side 11 and the rear side 12 are connected and can form a low frequency harmonic oscillation point by its gross electrical length. By such variation of space and top loading of the microstrip antenna sections, the dual frequency planar as well as miniaturized helix microstrip antenna with the stated superior performance can be obtained.

The preferred embodiment cited above is only for illustrating the present invention. It will be apparent to those skilled in this art that various modifications or changes can be made to the elements of the present invention without departing from the spirit and scope of this invention, all such modifications and changes also fall within the scope of the appended claims and are intended to form part of this invention.

What is claimed is:

1. A planar, dual frequency helix antenna comprising:

a) a single electric circuit board having opposite first and second surfaces;

b) a plurality of spaced apart first microstrip antenna sections on the first surface of the electric circuit board, each first microstrip antenna sections having a first width and being inclined in a first direction, the first microstrip antenna sections being spaced apart a first distance approximately four times the first width; and, c) a plurality of spaced apart second microstrip antenna sections on the second surface of the electric circuit board, each second microstrip having a second width and being inclined in a second direction different than the first direction, the second microstrip antenna sections being spaced apart a second distance approximately four times the second width whereby at least one end of each first microstrip antenna is connected to an end of a second microstrip antenna through a hole passing through the electric circuit board.

2. The planar, dual frequency helix antenna of claim 1 further comprising a top loading portion connected to an end of one of the first microstrip antenna sections.

3. The planar, dual frequency helix antenna of claim 2 wherein the top loading portion has a width of twice the first width.

4. The planar, dual frequency helix antenna of claim 2 further comprising an out feeding point connected to an end of one of the second microstrip antenna sections.

5. The planar, dual frequency helix antenna of claim 2 comprising three spaced apart second microstrip antenna sections.

6. The planar, dual frequency helix antenna of claim 1 comprising three spaced apart first microstrip antenna sections.

* * * * *